US005984724A

United States Patent [19]

McNeel

[11] Patent Number: 5,984,724

[45] Date of Patent: Nov. 16, 1999

[54] WATERPROOF LOW TEMPERATURE GEOPHYSICAL CONNECTOR

[75] Inventor: William O. McNeel, Houston, Tex.

[73] Assignee: GEO Space Corporation, Houston, Tex.

[21] Appl. No.: 09/056,725

[22] Filed: Apr. 7, 1998

[51] Int. Cl.[6] ..... H01R 13/56

[52] U.S. Cl. ..... 439/606; 439/281

[58] Field of Search ..... 439/606, 736, 439/281, 282, 680, 587, 589

[56] References Cited

U.S. PATENT DOCUMENTS

| | | | |
|---|---|---|---|
| 2,866,957 | 12/1958 | Raypholtz | 439/680 |
| 2,906,986 | 9/1959 | Schafer | 439/680 |
| 4,043,630 | 8/1977 | Suverison et al. | 439/606 |
| 4,114,970 | 9/1978 | Hall, Jr. | 439/589 |
| 5,595,497 | 1/1997 | Wood | 439/606 |
| 5,641,307 | 6/1997 | Gerrans | 439/606 |

*Primary Examiner*—Lincoln Donovan
*Assistant Examiner*—J. F. Duverne
*Attorney, Agent, or Firm*—Fulbright & Jaworski

[57] ABSTRACT

A geophysical connector (10) having a housing (46, 52) and first (11) and second (131) connection members. First member (11) includes a low durometer soft plastic body (12) molded to the electrical contacts (20, 21) and encloses a rigid waterproof molded seal (34) molded about said contacts (20, 21). The second connection member (131) includes a rigid plastic insert (133) supporting a second coacting electrical contacts (135, 137) and a soft plastic body (159) bonded to the insert (133) and the electrical cable (163) connected to the second contacts.

8 Claims, 6 Drawing Sheets

WATERPROOF LOW TEMPERATURE GEOPHYSICAL CONNECTOR

FIELD OF THE INVENTION

This invention relates to a waterproof connector that can be used in any geophysical field environment and is particularly able to be used at extreme low temperatures such as those encountered in the Arctic regions.

The connector includes a hard, rigid plastic housing with a first connector member and a second connection member each releasably secured to the housing.

The first member includes a low durometer relatively soft plastic molded body molded to one end of a plurality of electrical contacts and encloses a hard, rigid waterproof molded seal encapsulating a second end of the contacts which provides a seal and anchor through the connection to an electrical cable. The second member includes a hard, rigid plastic insert supporting second electrical contacts and includes a relatively soft plastic body bonded to the insert and to the electrical cable connected to the second contacts.

BACKGROUND OF THE INVENTION

Electrical connectors used in the geophysical field environment, most commonly, are plagued with a multiplicity of problems. The most common of these problems occurs when the cable that the connector is attached sustains a cut in the outer jacket allowing water to enter within the central cavity of the cable. Water migrates internally down the electrical conductors and enter into the center cavity of the connector body following a path to the electrical connections of either the pins or sockets which are molded within. If the two internal electrical conductor's outer jacket is cut through and to the metal stranded wire conductors then water will migrate internally and follow that path entering into the center cavity of the connector body thus reaching the electrical connection to the pin or socket. If the water communicates from one pin or one socket to the other electrical leakage or a short circuit condition will occur.

Another such problem encountered in the field environment relates to the connector's ability to mate and de-mate. A common design technique to seal the face of a connector is with a single molded facial O-ring or a multiplicity of molded O-rings to seal around individual pins or sockets. Another common design practice in use today is to mold an O-ring on the major outer diameter of a male connector which then mates within a central cavity of the receiving female connector that has a positioned mating O-ring groove designed to receive the O-ring of the male connector and thus provides a waterproof seal. However, the ability to mate and de-mate the connector in extreme low temperatures becomes very difficult if not impossible. Thus it becomes apparent that the design of the connector and the selection of the materials used to eliminate or minimize electrical leakage and has the ability to mate and de-mate in all environmental conditions becomes an absolute necessity.

The present invention embodies a moisture free, waterproof, low temperature electrical connector assembly in which one member includes a flexible, soft inner molded body for sealing in low temperatures is positioned within a hard, rigid protective outer housing and encloses a hard, rigid waterproof seal which acts also as an anchor. A second member includes a rigid insert which acts as a connection to the housing and as an anchor and includes a relative soft plastic body bonded thereto for sealing. A connector of this design operates equally as well in extremely cold weather areas, marsh or shallow bays or in the hot desert areas. An invention of this design will perform equally as well in the varied harshness of any geophysical field environment and maintains its electrical and mechanical ruggedness.

SUMMARY

The present invention is directed to a waterproof geophysical connector which, while useful in most any type of geophysical field environment, is particularly valuable in that it is effective when used at extreme low temperatures. The connector includes an outer hard, rigid plastic housing with first connection member and second connection member releasably secured to the housing. First and second coacting electrical contacts, one of which is male, and the other of which is female, are positioned in the first connection member and the second connection member, respectively. The first member includes a hard, rigid waterproof molded plastic encapsulating the second ends of the first contacts and their connection to an electrical cable thereby providing a waterproof seal and anchor. The first member also includes a low durometer relatively soft plastic body bonded to the plastic seal and the jacket of the electrical cable forming a single molecular bonded assembly.

Another feature of the present invention is wherein a first end of the soft plastic body includes a plurality of sealing cavities into which the first ends of the first contacts, which are bonded to the plastic body, are positioned in one of the cavities.

Another feature of the present invention is wherein in the soft plastic body of the first connector member is a urethane material of approximately 85 durometer for ease of mating and de-mating with the second connection member in extremely low temperatures.

Another feature of the present invention is wherein the soft plastic body of the first connector member encloses the hard, rigid waterproof plastic seal whereby the rigid seal also acts as an anchor when the electrical cable is subjected to rough field handling.

Still another feature of the present invention is wherein the first end of the soft plastic body of the first connector member includes an annular seal for engaging the second connector member.

Still a further object of the present invention is wherein the second connector member includes a hard, rigid metal insert connected to and supporting the second electrical contacts and the insert includes a cavity at one end into which one end of the second contacts extend into and in which the first end of the plastic body of the first connection member is engageable. In addition, the second connection member includes a relatively soft plastic body bonded to the insert and to the electrical cable connected to the second contacts.

Still another feature of the present invention is wherein the insert of the second connector member is threadably engageable with the housing.

Yet a still further object of the present invention is wherein in the insert of the second connector member includes grooves and a post at the second end for securely bonding to and supporting the soft plastic body bonded to the insert.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
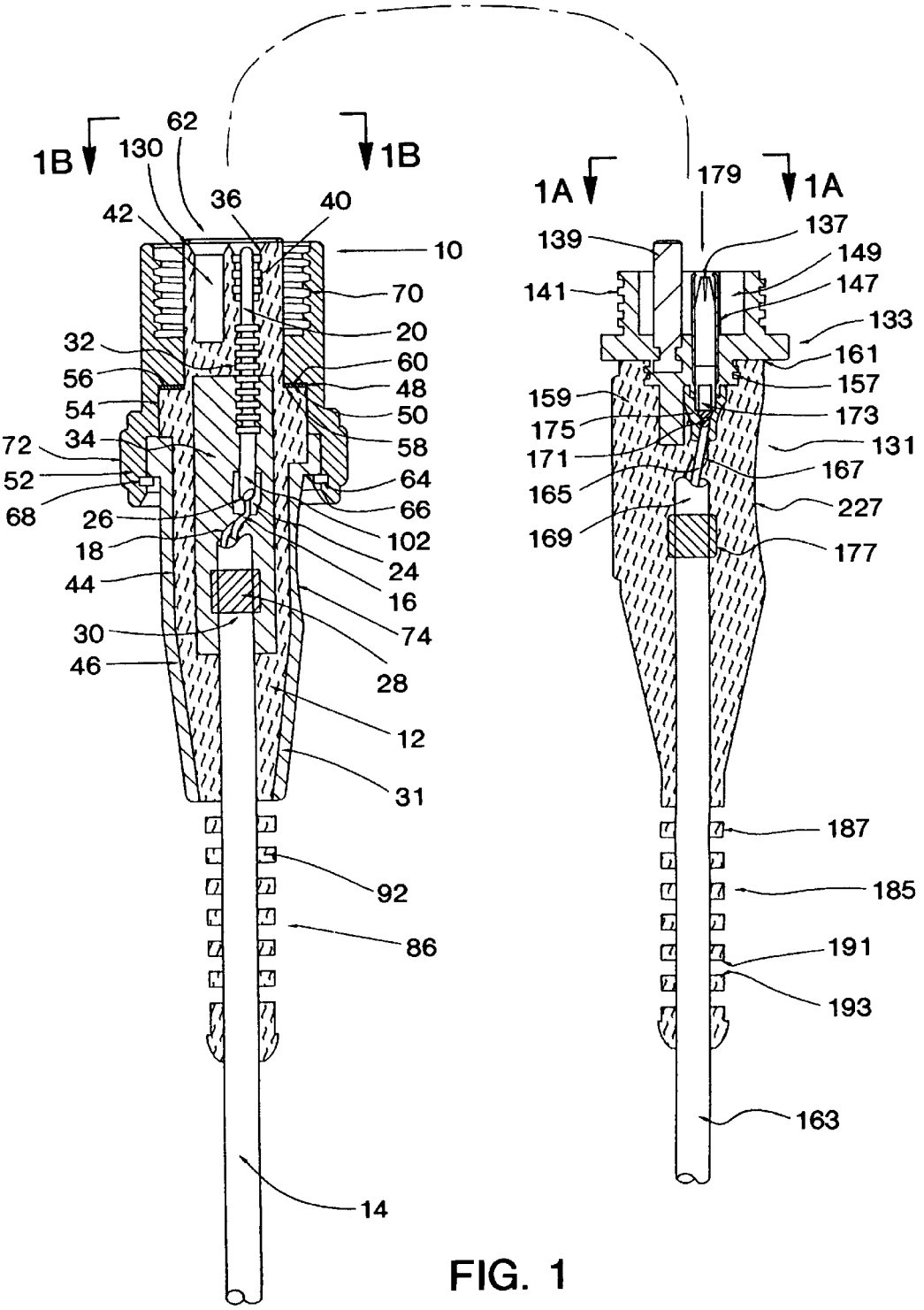
FIG. 1 is a an elevational view, in cross section, of the geophysical connector of the present invention showing the first member and the second member in a disconnected relationship.

Referring now to the drawings, and particularly to FIG. 1, the reference numeral 10 generally indicates the geophysical connector of the present invention and generally includes an outer housing consisting of a first part 46 and a second part 52, a first connector member 11 releasably securable in the housing, and a second connector member 131 releasably securable to the housing.

First and second coacting electrical contacts 20, 21 (FIGS. 1 and 1B) and contacts 135 and 137 (FIGS. 1 and 1A), respectively, one set of which is male and the other of which is female, are positioned in the first connector member 11 and the second connector member 131, respectively. That is, for purposes of illustration, the first member 11 is shown as a male connector member having male electrical contacts such as pins 20 and 22, and the second electrical connector 131 is shown as the female connector having female electrical contacts such as receptacles 135 and 137. Obviously, the coacting electrical contacts in the connectors 11 and 131 could be reversed.

Figure 1B:
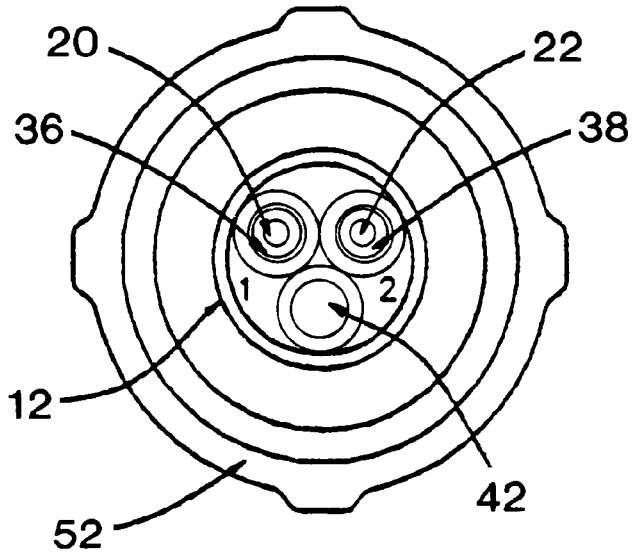
FIG. 1B is a cross-sectional view taken along the line 1B—1B of FIG. 1.
Figure 2B:
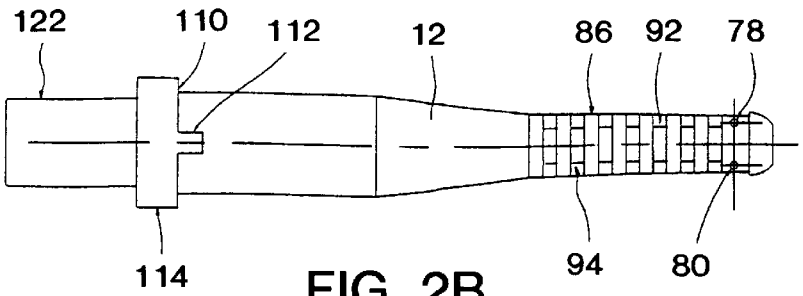
FIG. 2B is an elevational view of the assembled first member of FIG. 2A shown rotated 90°.
Figure 2A:
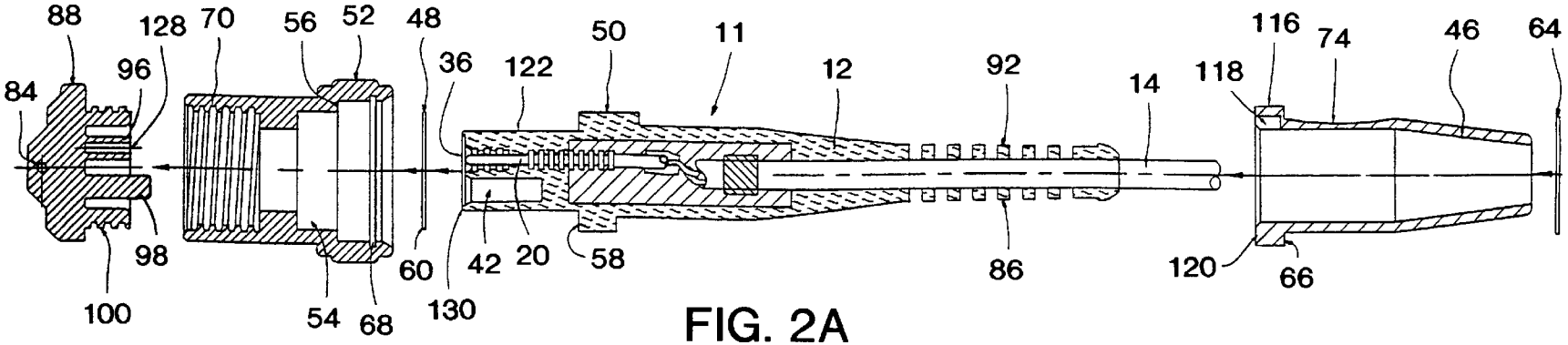
FIG. 2A is an elevational, exploded view, in cross section, of the first member of the connector with the addition of a dust cover.
Figure 3A:
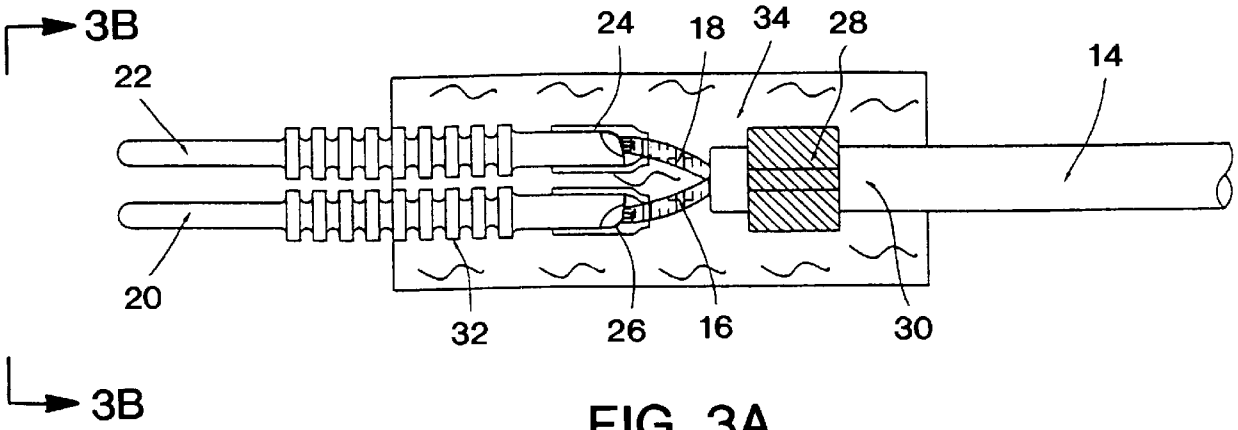
FIG. 3A is an enlarged elevational view showing the connection of an electrical cable to electrical contacts in a rigid waterproof plastic seal.

Referring now to FIGS. 1, 1B, 2A, 3A and 3B, the first connection member 11 includes a molded body member 12. Body member 12 is comprised of an injection molded relatively soft, non-conductive, resiliently compressible plastic material, such as urethane B.F. Goodrich #58300, 80 durometer, which has excellent low temperature characteristics to minus 40° F. That is, body 12 will mate and de-mate with second connector member 131 in extremely low temperatures in which outer types of materials would be frozen together. Body member 12 has a provision for receiving an electrical cable 14 has two electrical conductors 16 and 18 centrally located in its outer jacket 30. Conductors 16 and 18 are electrically attached, preferably with solder 26 at the second or receiving end of the solder receptacle socket 102 of pins 20 and 22. Shrink tubing with adhesive 24 slips over and is heat reduced in size to cover and encapsulate the solder electrical connection 26. As shown in FIGS. 1 and 3A, a cable clamp 28 molded in seal member 34, prevents internal movement of cable 14 when jacket 30 preferably comprised of an extruded urethane material, such as B.F. Goodrich #58300, 80 durometer is molded within body member 12. Electrical pins 20 and 22 have a plurality of outwardly extending annular grooves 32 to improve retention of the second ends of pins 20 and 22 and to enhance the sealing capabilities of urethane to metal bonding. Pins 20 and 22 preferably are comprised of brass or beryllium copper and are gold plated to insure intimate electrical contact with its mating socket receptacles 135 and 137 and to eliminate corrosion from occurring when exposed to the geophysical field elements. Cable clamp 28, conductors 16 and 18 and pins 20 and 22 are molded into a seal member 34. Seal member 34 comprised of a molded cylindrical body of hard, rigid, nonconductive, glass-filled urethane material, such as B.F. Goodrich, Estalock #59600, 95 durometer provides a waterproof enclosure which prevents water from migrating down the electrical cable 14 and conductors 16 and 18 which prevents any occurrence of electrical leakage. In addition, the hard, rigid member 34 acts as an anchor when force is applied to the cable 14 and prevents separation of pins 20 and 22 from the softer body 12.

As shown in FIG. 1, the body 12 and the cylindrical seal 34 are molded of compatible urethane material which bond together molecularly thus preventing any pathway for water to communicate between pins 20 and 22. Body member 12 at its first or receiving end has cavities 36 and 38 formed around each end of the electrical pins 20 and 22 and contains a plurality, such as three equally spaced internally molded O-rings 40 and facial O-ring 130 to engage, mate and provide a sealing means to the mating connector member 131. Body member 12 has a second end bonded to the seal 34 and to the jacket of cable 14. Preferably, the body member 12 entirely encloses seal 34.

Figure 3B:
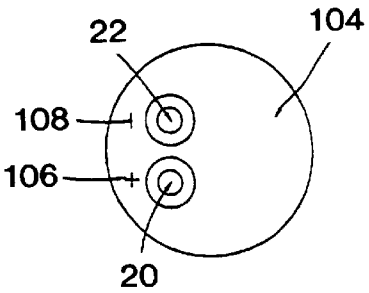
FIG. 3B is a cross-sectional view, taken along the line 3B—3B of FIG. 3A.

As shown in FIG. 3B, pins 20 and 22 are offset from the centerline of face 104 of seal member 34. Assuming that the electrical conductor 16 is designated as positive polarity then pin 20 is positioned within the assembly mold cavity that relates to the positive mark 106 of face 104. The electrical conductor 18 is then designated as the negative polarity and pin 22 is positioned within the assembly mold cavity that relates to the negative mark 108 of face 104.

The molded body assembly 12, as shown in FIG. 1 and FIG. 2A, is inserted into the central cavity 44 of the outer housing part 46. The outer housing 46 and part 52 are comprised of a hard, rigid, nonconductive, glass filled thermoplastic material, such as General Electrix Xenoy # 6221. This serves to protect the body 12.

As shown in FIG. 2B, body member 12 has a major diameter shoulder 114 with an alignment key 112 projecting outwardly from the rear face 110 of shoulder 114. The outer housing part 46 has a major diameter shoulder 116 and cavity 118 which projects inwardly from the face 120 of shoulder 116. The key 112 of shoulder 114 engages the cavity 118 of the shoulder 116 and prevents rotational movement between the two parts.

A spacer ring 48, preferably made of stainless steel or other suitable metal is inserted onto the facial small diameter projection 122 of body member 12 and abuts to the inner face 58 of the shoulder 50 and acts to prevent seizing when the soft shoulder 50 is in tight frictional engagement with spacer ring 48 during the connection 10 de-mating process. The body member 12 facial end is inserted within the central cavity 54 of outer housing part 52. Shoulder 56 of part 52 abuts to the outer face 60 of the stainless steel spacer ring 48. The stainless steel spiral locking ring 64 is inserted into an internally disposed groove 68 of housing part 52 and engages the shoulder 66 of the outer housing part 46 securing the assembly in a locking engagement. A plurality of internal threads 70 of part 52 disposed at its facial end is adapted to mate with a plurality of external threads 141 of the second connector member 131. External projecting grips 72 aids in the gripping and turning of the part 52 during assembly or disassembly of the connector 10.

Figure 4:
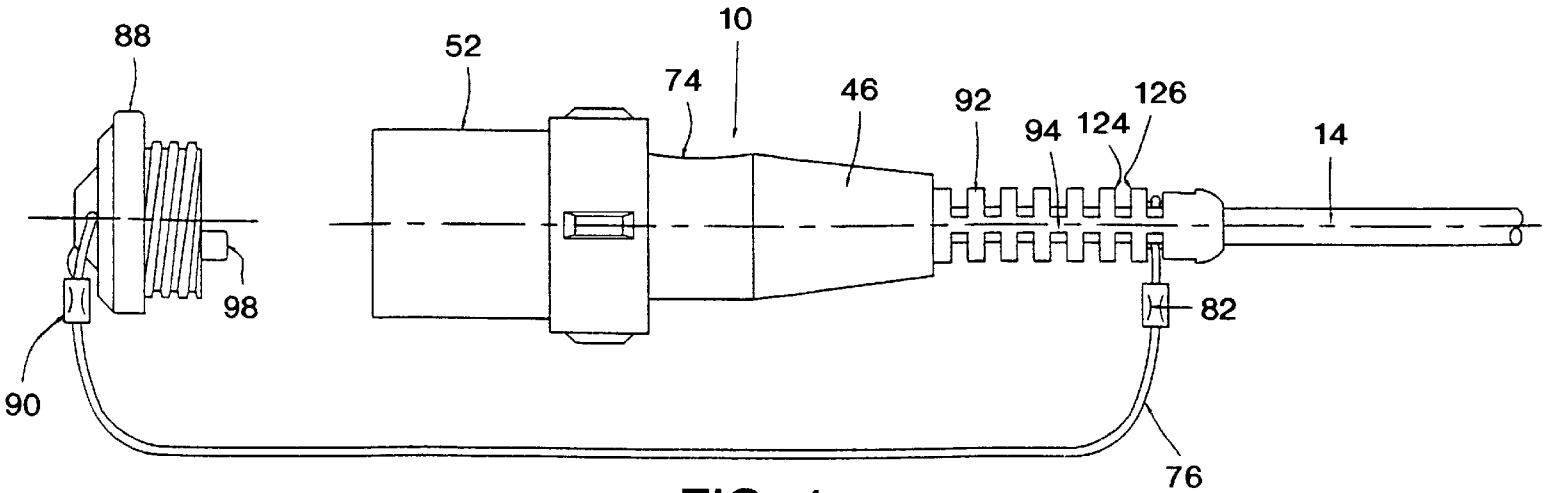
FIG. 4 is an elevational view of the first member of the connector complete with an attached dust cover.

As shown in FIG. 4, a radius depress thumb positioner 74 allows for the ease of aligning the cavity 42 of the face 62 of the body member 12 with the mating connector alignment pin 98 of a dust cover 88 without having to look at the facial end of connector member 11.

One end of a stainless steel profax jacketed wire rope 76 is inserted through the hole 78 of the cable bend limiter 86 and is guided over and into and through the hole 80. The wire rope 76 is inserted into and through the metal clamp 82 and then crimped securely in place. The opposite end of the wire rope 76 is inserted into and through the hole 84 of the dust cover 88 then inserted through the metal clamp 90 and crimped securely in place.

The molded body member 12, as shown in FIG. 4, has at its cable entry area end an integrally molded cable bend limiter 86. The cable bend limiter 86 has a plurality of limiting rings 92 and bend limiting ring tie-bar 94 all securely molded to the electrical cable 14. Bend limiting rings 92 restrict the arc through which the electrical cable 14 can flex when the limiting rings 92 compress and engage at corners 124 and 126.

As shown in FIG. 2A, the dust cover 88 has a pair of mating pins 96 which engage the cavity 36 and 38 of the body member 12 providing intimate contact with the plurality of sealing O-rings 40 thus sealing the cavities 36 and 38 when the connector 10 is not in service. The male key pin 98 of the dust cover 88 projects outwardly and engages the cavity 42 of the body member 12 and aligns the pins 96 to engage the cavities 36 and 38 of the body member 12. Pins 20 and 22 of the body member 12 are inserted within cavities 128 of the male pins 96, of the dust cover 88, when in threaded engagement with part 52. A plurality of external threads 100 of the dust cover 88 are mated in a threaded engagement with that of the internal threads 70 of the housing part 52.

As shown in FIGS. 1, 5 and FIGS. 6A, 6B and 6C, the mating female connector member 131 has a facial insert 133 that has a pair of electrical female sockets 135 and 137 and an alignment pin 139. Facial insert 133, comprised preferably of a molded hard, rigid, non-conductive glass filled urethane material, such as B.F. Goodrich, Estalock, #59600, 95 durometer, has a plurality of external threads 141 disposed at its facial end which mates in a threaded engagement with a plurality of internal threads 70 of the connector member 11. Electrical female sockets 135 and 137, comprised preferably of heat treated Beryllium copper and gold plated to ensure an intimate contact with pins 20 and 22 of connector member 11 and prevent corrosion from occurring in the field environment, are molded and bonded within the socket outer case shields 145 and 147 of the facial insert 133. Alignment pin 139, comprised of brass or other suitable material, is molded within the cavity 149 and projects outwardly to engage cavity 42 of the mating connector 11. The electrical female sockets 135 and 137 of the connector 131 are aligned with cavities 36 and 38 and receive pins 20 and 22 of the connector 11 within the cavities 153 and 155 of the electrical female sockets of the connector 131.

Figure 6A:
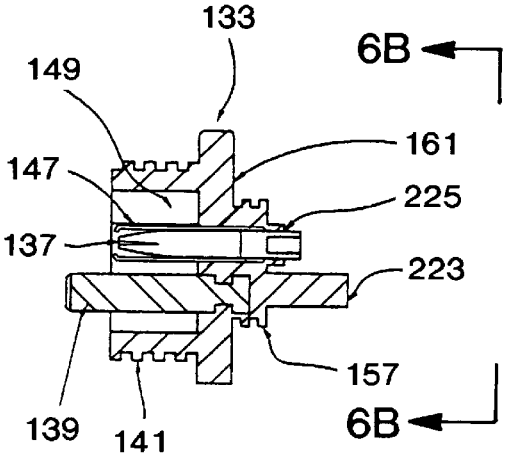
FIG. 6A is an elevational view in cross section of a plastic insert of the second member of FIG. 5.
Figure 6B:
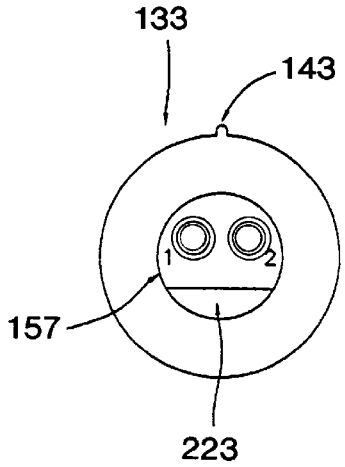
FIG. 6B is a cross-sectional view taken along the line 6B—6B of FIG. 6A.

The electrical female sockets 135 and 137 outer case shields 145 and 147 communicate in a compression like manner with O-rings 40 of the connector 10 forming a water exclusionary boundary thus sealing cavities 36 and 38 of the connector 10, as shown in FIG. 1. Sight alignment key 143 projects upwardly from the major diameter of the facial insert 133 and provides for the ease of case aligning of connector member 11 and connector member 131 without having to look at the face of the connectors. Disposed at the rear of the facial insert 133, as shown in FIGS. 6A and 6C, a plurality of inwardly extending annular grooves 157 and rear projection post 223 increase the surface area for bonding and retention of the body member 159. Body member 159, comprised of an injection molded relatively soft, non-conductive, resilient urethane material, such as B. F. Goodrich, #58810, 85 durometer has excellent properties, which allows the connector to be used in any geophysical environment. The facial insert 133 and the body member 159 are injection molded with compatible urethane materials which bonds molecularly to the rear face area 161, annular grooves 157 and rear projection post 223 thus excluding water from entering within the body member 159.

Body member 159 has a provision for receiving an electrical cable 163 which has two electrical conductor wires 165 and 167, centrally located within its outer jacket 169. Electrical conductor wires 165 and 167 are electrically attached preferably with solder 171 at the receiving end of the solder receptacle socket 173 of the electrical female sockets 135 and 137. Shrink tubing 175 with adhesive is slipped over and is heat reduced in size to cover shoulder 225 and the electrical conductor wires 165 and 167 and encapsulated the electrical solder connection 171. As shown in FIG. 1, cable clamp 177 when crimped prevents internal movement of cable 163. The outer jacket 169 of the electrical cable 163, comprised of an extruded urethane material, such as B.F. Goodrich, #58300, 80 durometer is centrally located within the body member 159. The outer jacket 169 and body member 159 being of compatible urethane material molecularly bond to each other and prevent water from migrating down the length of the cable 163 and from entering within body member 159. If desired, a rigid, waterproof plastic seal similar to seal 34 of connector member 11 could be used inside body 159. However, the rigid insert 133 performs the function of an anchor to prevent separation of electrical contacts 135 and 137.

Figure 1A:
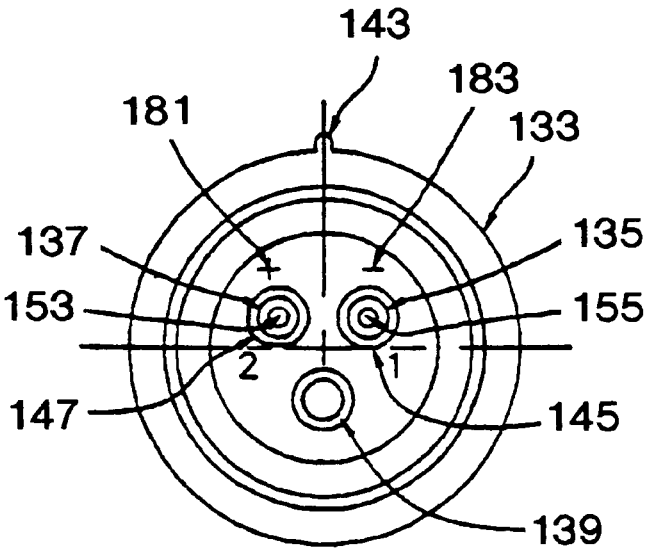
FIG. 1A is a cross-sectional view taken along the line 1A—1A of FIG. 1.

As shown in FIGS. 1, 1A and 6A, the electrical female sockets 135 and 137 are offset from the center line of the face 179 of the facial seal 133. Assuming that the electrical conductor wire 165 is designated as the positive polarity then the electrical female socket 137 is positioned within the assemblies mold cavity that relates to the positive mark 181 of the face 179 of the facial insert 133. The electrical conductor wire 167 is then designated as the negative polarity and the electrical female socket 135 is positioned within the assemblies mold cavity that relates to the negative mark 183 of the face 179 of the facial insert 133. When the female connector 131 is mated to the male connector 11 the positive designated electrical socket 137 of connector 131 is making intimate electrical engagement with the positive designated electrical pin 20 of the male connector 11. When the negative designated electrical socket 135 of connector 131 is an intimate electrical engagement with the negative designated electrical pin of connector 11 an in phase electrical condition exists between the female connector 131 and the male connector 11.

Figure 5:
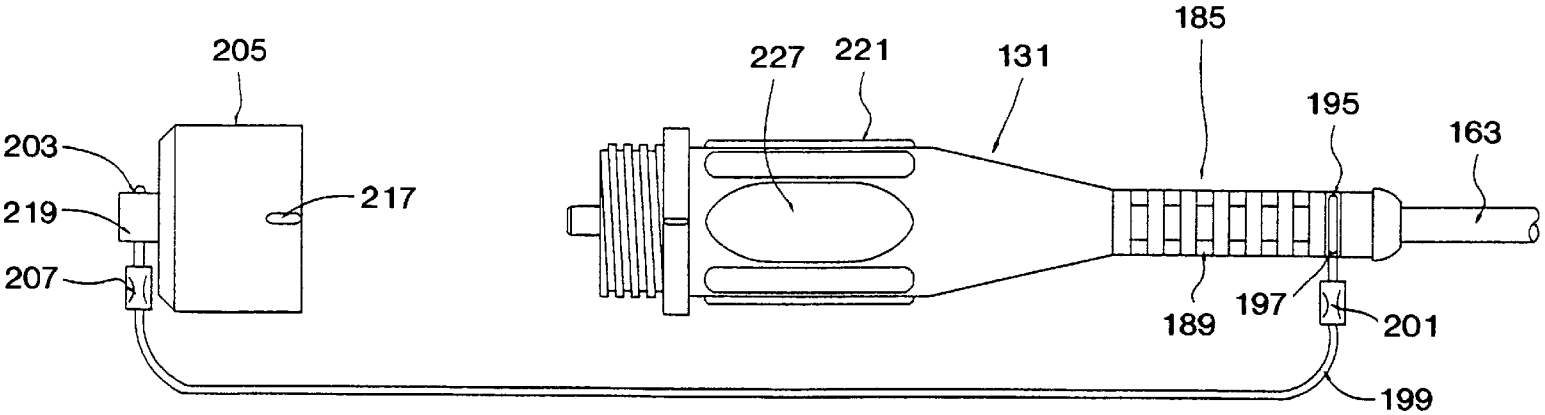
FIG. 5 is an elevational view of the second member of the geophysical connector along with an attached dust cover.

The molded body member 159, as shown in FIGS. 1 and 5 has at its cable entry area an integrally molded cable bend limiter 185. The cable bend limiter 185 has a plurality of limiting rings 187 and bend limiting tie-bar 189 all securely molded to the electrical cable 163. The bend limiting rings 187 restricts the arc through which the electrical cable 163 can flex when limiting rings 187 are in a compression engagement which occurs at the corners 191 and 193.

Figure 7A:
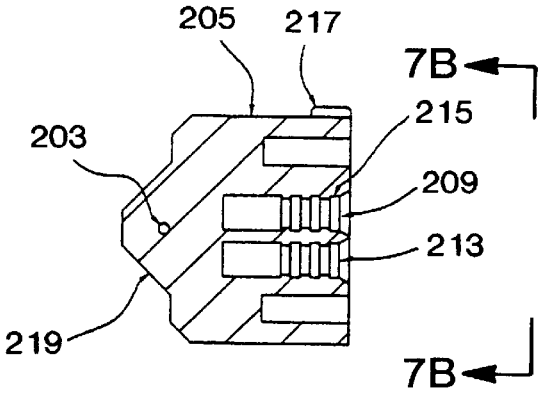
FIG. 7A is a cross-sectional view of the dust cover shown in FIG. 5.

Securing holes 195 and 197 at the rear of the cable bend limiter 185 are provided to accept a stainless steel jacketed wire rope 199. The wire rope 199 is inserted through the cable clamp 201 and hole 195 then directed over the electrical cable 163 and into and through the hole 197. The wire rope 199 is inserted into the metal clamp 201 and securely crimped in place. Clamp 207 is inserted onto the opposite end of the wire rope 199 and is then inserted into and through the hole 203, as shown in FIG. 7A, of the wire rope retainer 219 of dust cover 205. The end of the wire rope 199 is inserted into and through the cable clamp 207 and securely crimped in place.

Figure 7B:
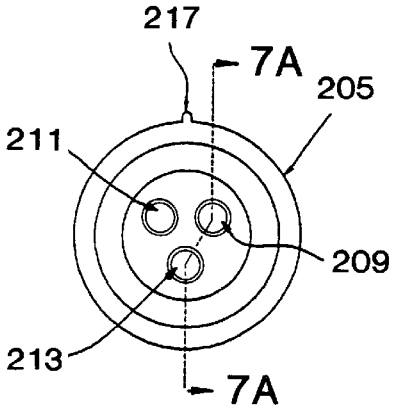
FIG. 7B is a cross-sectional view taken along the line 7B—7B of FIG. 7A.

As shown in FIGS. 7A and 7B, the dust cover 205 comprised of an injection molded relatively soft, non-conductive, resilient, compressible urethane material, such as B.F. Goodrich, #58300, 80 durometer that has excellent low temperature properties to −40° F. Dust cover 205 at its receiving end has a plurality of cavities 209, 211 and 213 which contain equally spaced internally molded O-rings 215. O-rings 215 engage, mate and provide a sealing means to the socket shields 145 and 147 of the facial insert 133 thus preventing moisture from entering within the electrical female socket cavity 153 and 155 when connector 131 is not in service. Sight alignment key 217 located at the top of the major diameter of dust cover 205 projects upwardly and provides for the ease of aligning the cavities 109, 211 and 213 with the electrical female socket shields 145 and 147 and the alignment pin of the facial insert 133. Projecting from the rear of the dust cover 205 extending outwardly the wire rope retainer 219 with hole 203 from a means to secure the dust cover 205 to the connector 131.

As shown in FIG. 5, a radius depression thumb positioner 227 allows for the ease of aligning the electrical sockets 135 and 137 and the alignment pin 139 centrally spaced within the cavity 149 of the facial insert 133 to align and mate with pins 20 and 22 and alignment pin 139 within cavity 36, 38 and 42 of the body 12 of connector 11.

Thumb depression positioned 74 of male connector 10 and thumb depression positioner 227 of female connector 131 are position in lined at the top each connector so the assembler need only to position his thumbs in the depressions to mate the connector without having to look at the face of each.

As shown in FIG. 5, external projecting grips 221 extend outwardly on the body member 159 and aids in the gripping of the female connector 131 during assembly and disassembly of the male connector 10.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. A waterproof, low temperature geophysical connector comprising, an outer, hard rigid plastic housing, a first connection member releasably secured to the housing, and a second connection member releasably secured to the housing, first and second coaching electrical contacts, one of which is male and the other of which is female, positioned in the first connection member and the second connection member, respectively, each of said contacts having first and second ends, said second ends of the contacts electrically connected to an electrical cable, respectively, said first connection member including a hard, rigid waterproof molded plastic seal encapsulating the second ends of the first contacts and the electrical connection to the electrical cable, said first connector member including a low durometer relative soft plastic body having first and second ends, said body bonded to and enclosing the plastic seal and the second ends of the contacts, and said first end of the body including a plurality of sealing cavities, said first ends of the first contacts bonded to the plastic body and positioned in one of the cavities, said second connection member including, a hard, rigid plastic insert connected to and supporting the second electrical contacts, said insert including a cavity at one end into which one end of the second contacts extend and into which the first end of the plastic body of the first connection member is engageable, said second connection member including a relative soft plastic body bonded to the insert and to the electrical cable connected to the second contacts.

2. The connector of claim 1 wherein the soft plastic body of the first connector member is a urethane material of approximately 80 durometer.

3. The connector of claim 1 wherein the first end of the soft plastic body of the first connector member includes an annular seal for engaging the insert of the second connector member.

4. The connector of claim 1 wherein the second end of the soft plastic body of the first connector member is bonded to the electrical cable connected to the first electrical contacts.

5. The connector of claim 1 wherein the soft plastic body of the second connector member is a urethane material of approximately 85 durometer.

6. The connector of claim 1 wherein the insert of the second connector member is threadably engageable with the housing.

7. The connector of claim 1 wherein the insert of the second connector member includes grooves and a post at a second end for securely bonding to and supporting the soft plastic body bonded to the insert.

8. The apparatus of claim 1 including a cable clamp molded in and enclosed in the plastic seal and connected to the electrical cable.

* * * * *

UNITED STATES PATENT AND TRADEMARK OFFICE

CERTIFICATE OF CORRECTION

PATENT NO. : 5,984,724

DATED : November 16, 1999

INVENTOR(S) : William O. McNeel

It is certified that error appears in the above-identified patent and that said Letters Patent is hereby corrected as shown below:

Column 8, line 10, delete "coaching" and insert - - coacting - -

Signed and Sealed this

Second Day of January, 2001

*Attest:*

*Attesting Officer*

Q. TODD DICKINSON

*Commissioner of Patents and Trademarks*